US005324132A

United States Patent [19]

Hunter et al.

[11] Patent Number: 5,324,132

[45] Date of Patent: Jun. 28, 1994

[54] HINGE CONNECTION

[75] Inventors: Norman R. Hunter, Hayward; John G. Herrera, Pleasanton, both of Calif.

[73] Assignee: Simpson Strong-Tie Company, Inc., San Leandro, Calif.

[21] Appl. No.: 958,641

[22] Filed: Oct. 7, 1992

[51] Int. Cl.[5] ..... E04B 1/00

[52] U.S. Cl. ..... 403/232.1; 403/231; 52/702

[58] Field of Search ..... 403/232.1, 231, 230; 52/702, 283

[56] References Cited

U.S. PATENT DOCUMENTS

| | | | |
|---|---|---|---|
| 2,115,625 | 4/1938 | Fleshman | 52/702 |
| 2,477,163 | 7/1949 | Barnett | 403/232.1 |
| 4,856,252 | 8/1989 | Cornell | 403/232.1 |

FOREIGN PATENT DOCUMENTS

| | | | |
|---|---|---|---|
| 0808615 | 2/1981 | U.S.S.R. | 52/702 |

OTHER PUBLICATIONS

P. 12, Simpson Co. copyright Oct. 1967.
P. 14, Simpson Co. copyright 1971.
P. 19, Simpson Co. copyright Sep. 1978.
P. 22, Simpson Co. copyright 1979.
P. 22, Simpson Co. copyright 1981.
P. 45, Simpson Strong-Tie Co., Inc. copyright 1991.
American Institute of Timber Construction Jul. 18, 1984 FIGS. 3.1 and 3.2.
P. 28, Lumberlock catalog, copyright Dec. 1988.
P. 16, KC Metal Products catalog, copyright Dec. 1991.

*Primary Examiner*—P. Austin Bradley
*Assistant Examiner*—Rex E. Pelto
*Attorney, Agent, or Firm*—James R. Cypher

[57] ABSTRACT

A hinge connection for joining a heavy carrying wood member such as a glulam and a carried wood member having different depth dimensions including a metal hinge connector having side members disposed on opposite sides of the carrying and carried wood members joined at a lower portion by a seat member and at upper portions by a top flange member. The hinge connection is particularly suited for structures subject to earthquakes, hurricanes and other cataclysmic events which subject the structure to uplift and lateral forces in addition to the specified gravity load design forces.

3 Claims, 3 Drawing Sheets

HINGE CONNECTION

BACKGROUND

A special type of connector for joining a heavy carrying wood member such as a glulam and a carried wood member having different depth dimensions is commonly known as a hinge connector. Hinge connections typically occur at the intersection of a carrying post member and a carried beam member or a cantilevered carrying beam and a carried beam. The connector evolved from a rhomboid shaped member having parallel side, a seat and a top flange joined by welding the separate members. Later a hinge connector evolved being constructed from a pair of U-hangers inverted and joined at their edges. The seat of one U-hanger formed the seat for carrying the carried member and the seat of the inverted U-hanger formed the flange carried by the carrying member. As seismic considerations dictated that additional horizontal resistance be provided by the hinge connector, tabs were added at both the top and bottom of the side members providing bolt openings for insertion therethrough and into the carried and carrying members.

The hinge connector remained locked into the above described design both by code and engineering approval as well as by commercial acceptance even though the hinge had many shortcomings. The prior art hanger required too many parts, and too many welds resulting in an expensive connector to manufacture. The connector due to its evolving design resulted in a connector which took too much space to store in inventory and to ship. More importantly, the connector provided little torsional resistance even though torsional forces were known to occur in cataclysmic disturbances such as earthquakes, hurricanes and typhoons. In spite of the need for an improved hinge connector, the industry stayed with the old hinge connector.

SUMMARY OF THE INVENTION

The gist of the present invention is to eliminate the separate tab members and thereby reduce the number of pieces in the connector; the more complicated connectors being reduced from ten separate pieces to four. Reduction of the number of pieces eliminated complicated jigging, reduced the number of welds and reduced the number of welds to inspect.

Even though the number of pieces is reduced in the present hinge connector, the torsional resistance of the connector is substantially improved.

The construction of the hinge connector has been changed so that it is thinner permitting easier installation of other connectors at the same location such as saddle hangers and top flange beam hangers.

A feature of the present invention is the fact that bolt holes may be staggered reducing the tendency of the bolt holes to cause splitting of the carried and carrying wood beam members.

Finally, shipping and storage costs are reduced because the hinge connector of the present invention nests, is shorter, and takes up less storage space.

DESCRIPTION OF THE INVENTION

Figure 1:
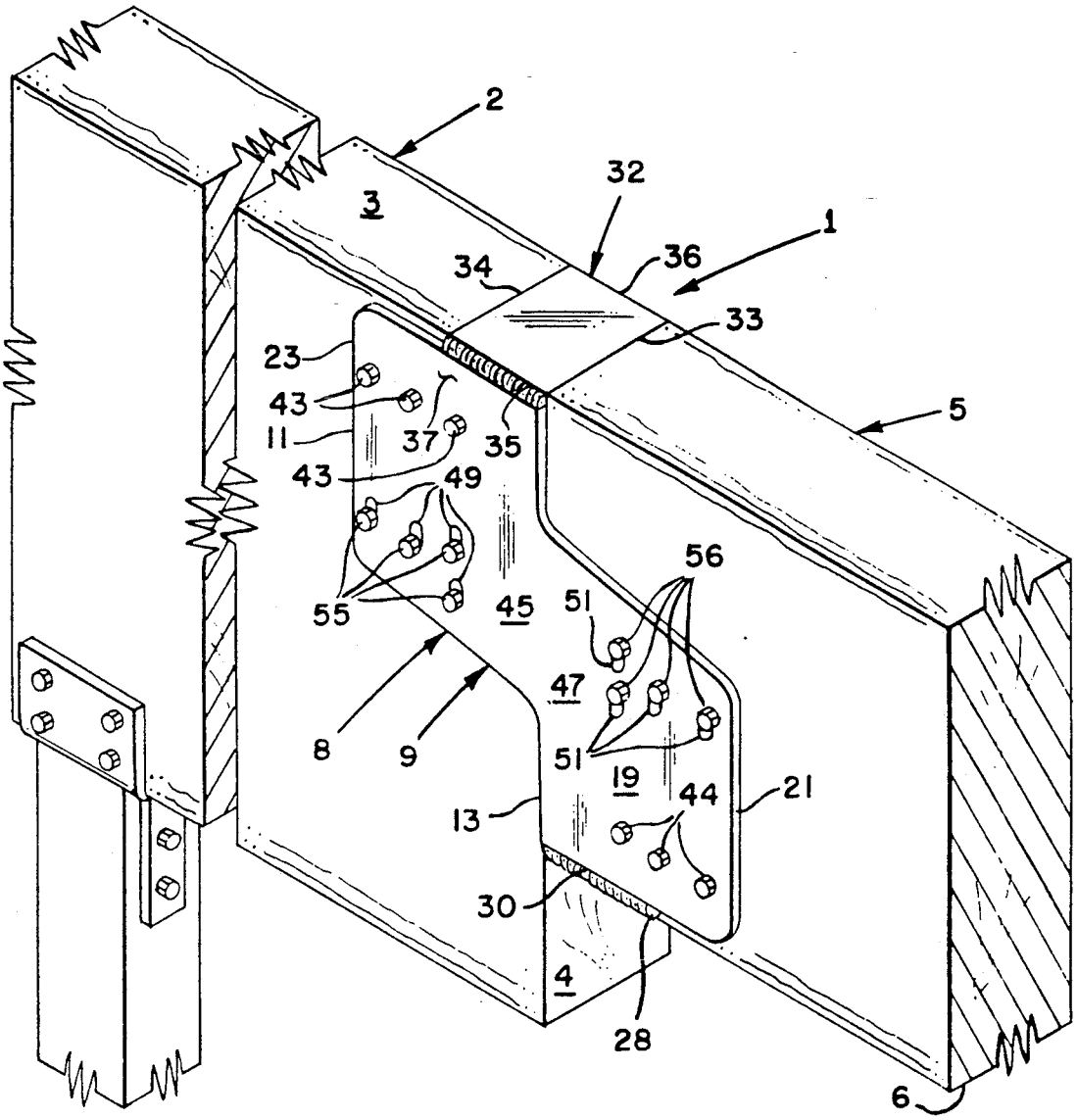
FIG. 1 is a perspective view of a hinge connection constructed in conformance with the present invention illustrating a metal hinge connector joining a carrying cantilever beam to a carried wood beam.
Figure 2:
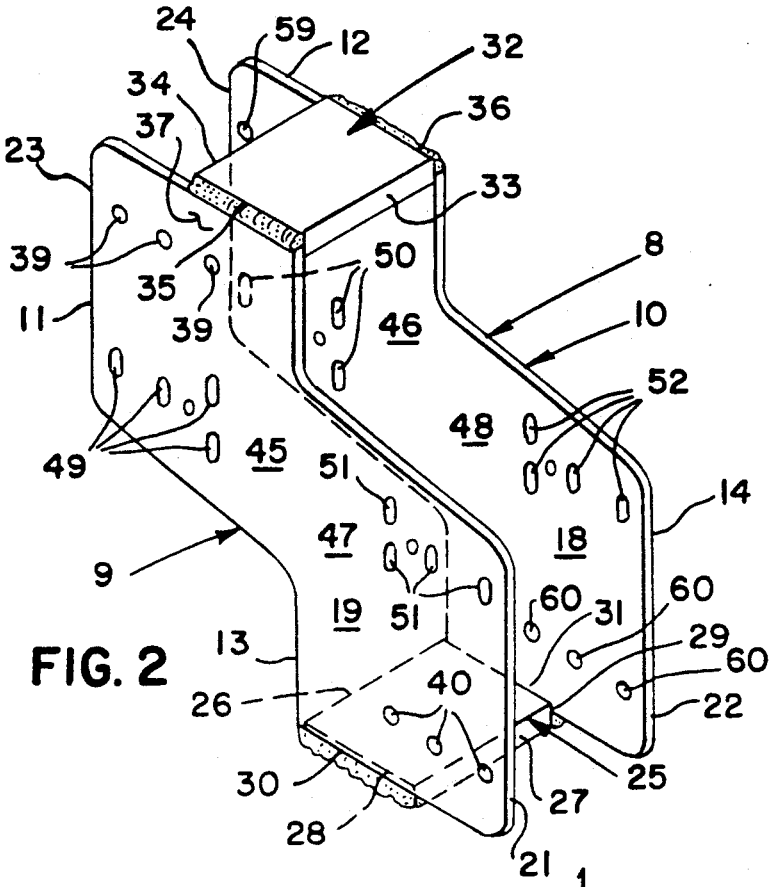
FIG. 2 is a perspective view of a metal hinge connector illustrated in FIG. 1.
Figure 3:
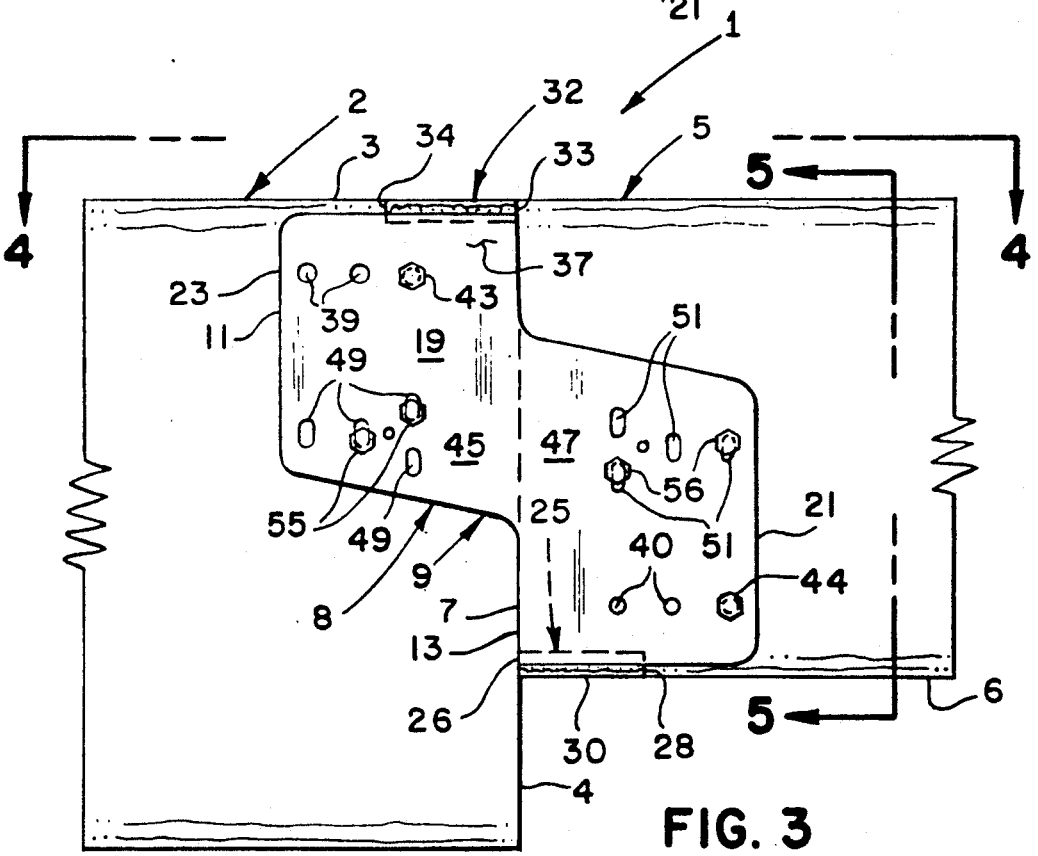
FIG. 3 is a side elevation view of the hinge connection illustrated in FIG. 1
Figure 4:
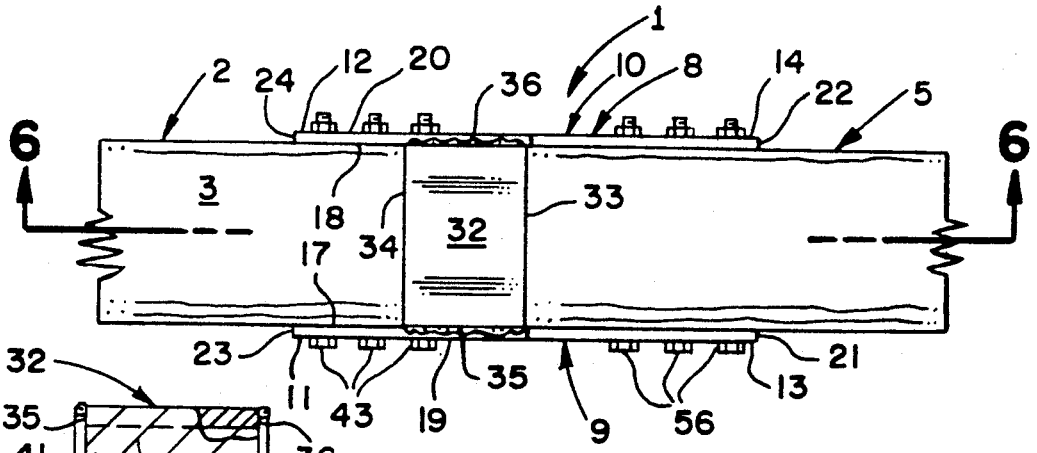
FIG. 4 is a top plan view of the hinge connection illustrated in FIG. 3 taken generally along line 4—4.
Figure 5:
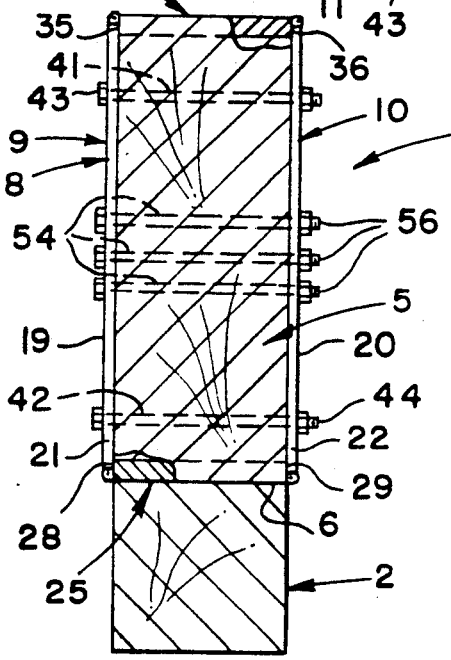
FIG. 5 is a cross sectional view taken along line 5—5 in FIG. 3.
Figure 6:
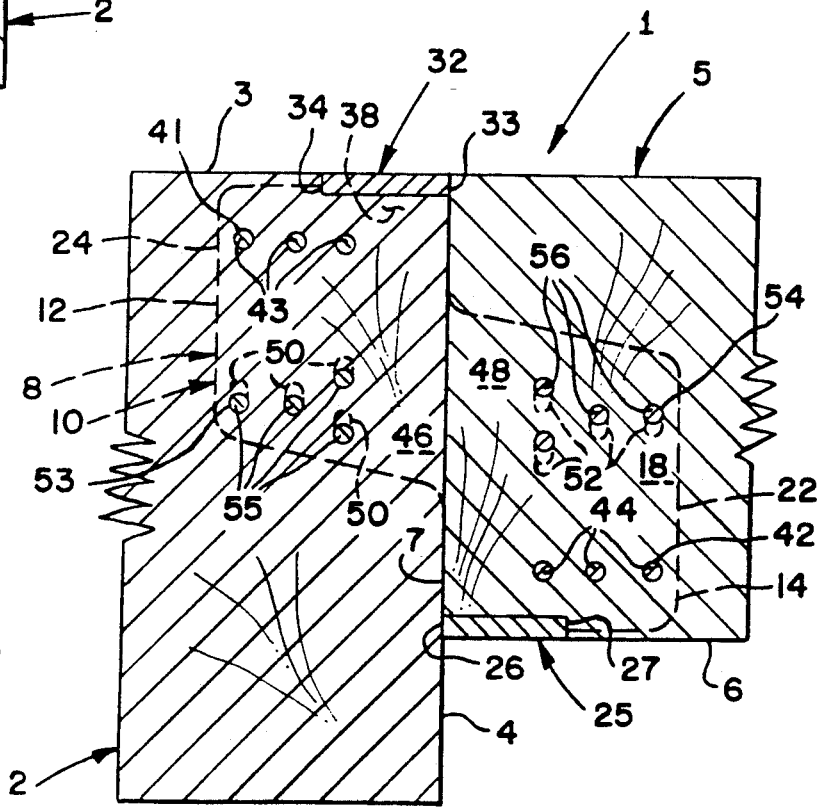
FIG. 6 is a longitudinal cross sectional view taken along line 6—6 in FIG. 4.

The hinge connection 1 of the present invention consists of a carrying member 2 having a top face 3 and an end face 4; a carried member 5 having a bottom face 6 and an end face 7; a hinge connector 8 including: first and second side members 9 and 10 disposed in lateral spaced relation, each having upper portions 11 and 12, and lower portions 13 and 14 and generally planar inner faces 17 and 18, and outer faces 19, and 20, and front edges 21 and 22 and rear edges 23 and 24; a seat member 25 for receiving and holding the bottom face 6 of the carried member 5 and having a rear edge 26 and a front edge 27 wherein the front edge 27 is disposed inwardly from the front edges 21 and 22 of the first and second side members 9 and 10, and side edges 28 and 29 joined to a portion 30 and 31 of the lower portions 13 and 14 of the first and second side members 9 and 10; a top flange member 32 disposed above the seat member 25 for resting upon the top face 3 of the carrying member 2 and having a front edge 33 and a rear edge 34 wherein the rear edge 34 is disposed inwardly from the rear edges 23 and 24 of the first and second side members 9 and 10, and side edges 35 and 36 are joined to portions 37 and 38 of the upper portions 11 and 12 of the first and second side members 9 and 10; the front edge 33 of the top flange 32 is spaced generally vertically above the rear edge 26 of the seat member 25; a plurality of carrying member openings 39 and 59 formed in the upper portions 11 and 12 of the first and second side members 9 and 10 adjacent the top flange member 32 and dimensioned for closely engaging fasteners inserted therein; a plurality of carried member openings 40 and 60 formed in the lower portions 13, and 14 of the first and second side members 9 and 10 adjacent the seat member 25 and dimensioned for closely engaging fasteners inserted therein; a plurality of carrying member bore holes 41 drilled in the carrying member 2 in registration with the carrying member openings 39 and 59 formed in the upper portions 11 and 12 of the first and second side members 9 and 10 and dimensioned for closely engaging fasteners inserted therein; a plurality of carried member bore holes 42 drilled in the carried member 5 in registration with the carried member openings 40 and 60 formed in the lower portions 13 and 14 of the first and second side members 9 and 10 and dimensioned for closely engaging fasteners inserted therein; a plurality of carrying fasteners 43 dimensioned for insertion through the carrying member openings 39 and 59 of the first and second side members 9 and 10 and through the carrying member bore holes 41 of the carrying member 2; and a plurality of carried fasteners 44 dimensioned for insertion through the carried member openings 40 of the first and second side members 9 and 10 and through the carried member bore holes 42 of the carried member 5.

In another form of the invention the hinge connection as described above is constructed and further include:

the first and second side members 9 and 10 are integrally formed with carrying mid-portions 45 and 46 located below and adjacent to the carrying member openings 39; the first and second side members 9 and 10 are integrally formed with carried mid-portions 47 and 48 located above and adjacent to the carried member openings 40; the carrying mid-portions 45 and 46 of the first and second side members 9 and 10 are formed with a carrying member series of horizontally restraining openings 49 and 50 dimensioned for permitting relative vertical movement of fasteners therein; the carried mid-portions 47 and 48 of the first and second side members 9 and 10 are formed with a carried member series of horizontally restraining openings 51 and 52 dimensioned for permitting relative vertical movement of fasteners therein; a plurality of horizontally restraining carrying member bore holes 53 drilled in the carrying member 2 in registration with the carrying member series of horizontally restraining openings 49 formed in the carrying mid-portions 45 and 46 of the first and second side members 9 and 10 and dimensioned for permitting relative vertical movement of fasteners therein; a plurality of horizontally restraining carried member bore holes 54 drilled in the carried member 5 in registration with the carried member series of horizontally restraining openings 51 and 52 formed in the carried mid-portions 47 and 48 of the first and second side members 9 and 10 and dimensioned for permitting relative vertical movement of fasteners inserted therein; a plurality of horizontally restraining carrying member fasteners 55 dimensioned for insertion through the carrying member series of horizontally restraining openings 49 and 50 and the horizontally restraining carrying member bore holes 53 drilled in the carrying member 2; and a plurality of horizontally restraining carried member fasteners 56 dimensioned for insertion through the carried member series of horizontally restraining openings 51 and 52 and horizontally restraining carried member bore holes 54 drilled in the carried member 5.

The hinge connection as described above may be constructed with the carrying member series of horizontally restraining openings 49 and 50, and the carried member series of horizontally restraining openings 51 and 52 generally located at the same elevation. Preferably, however, the carrying member series of horizontally restraining openings 49 and 50 and the carried member series of horizontally restraining openings 51 and 52, are located so that some are located at different elevations so as to avoid creating split planes in the carried and carrying members 5 and 2.

The hinge connection previously described may be constructed so that each of the first and second side members 9 and 10 are respectively continuous between the carried member openings 40 and 60 and the carried member series of horizontally restraining openings 51 and 52, each of the first and second side members 9 and 10 are respectively continuous between the carrying member openings 39 and 59 and the carrying member series of horizontally retaining openings 49 and 50, and each of the first and second side members 9 and 10 are respectively continuous between the carrying member series of horizontally restraining openings 49 and 50 and the carried member series of horizontally restraining openings 51 and 52.

The first and second side member 9 and 10 of hinge connector 8 of the present invention may be made from 7 gauge steel. The seat member 25 and top flange member 32 may be constructed from steel having a thickness from ¾" to 1 ½", a width of from 5 ¼" to 10 ⅞", and a length of 5" to 9".

Allowable roof loads for hinge connections 1 having two carrying fasteners 43 and two carried fasteners 44 varies from 14,350 pounds to 32,320 pounds. For hinge connections 1 having three carrying fasteners 43 and three carried fasteners 44, the allowable roof loads may vary from 14,350 pounds to 46,545 pounds.

As an example a commercial hinge connector 8 having a model no. HCA9-7 has a width of 8 ⅞", a seat member 25 and a top flange member 32 thickness of 1 ¼", a top flange member length of 7", and has an allowable roof load of 34,300 pounds if their are two carrying fasteners 43 and two carried fasteners 44, and an allowable roof load of 34,300 pounds if the minimum height between the seat member 25 and the bottom of the top flange member 32 is 34 ½". For the same hinge connector 8 having three carrying fasteners 43 and three carried fasteners 44 and a minimum height of 25 ½", the allowable roof load is the same at 34,300 pounds.

All fasteners in the foregoing examples are ¾" in diameter.

The carrying member 2 and carried member 5 may be a single piece sawn timber, but normally the carrying and carried members would be glulam beams.

We claim:

1. A hinge connection comprising:

a. a carrying member having a top face and an end face;

b. a carried member having a bottom face and an end face;

c. a hinge connector including:

(i). first and second side members disposed in lateral spaced relation, each having upper, and lower portions and generally planar inner and outer faces, and front and rear edges;

(ii). a seat member for receiving and holding said bottom face of said carried member and having a rear edge and a front edge wherein said front edge is disposed inwardly from said front edges of said first and second side members, and side edges joined to a portion of said lower portions of said first and second side members;

(iii). a top flange member disposed above said seat member for resting upon said top face of said carrying member and having a front edge and a rear edge wherein said rear edge is disposed inwardly from said rear edges of said first and second side members, and side edges are joined to portions of said upper portions of said first and second side members;

(iv). said front edge of said top flange is spaced generally vertically above said rear edge of said seat member;

(v). a plurality of carrying member openings formed in said upper portions of said first and second side members adjacent said top flange member and dimensioned for closely engaging fasteners inserted therein;

(vi). a plurality of carried member openings formed in said lower portions of said first and second side members adjacent said seat member and dimensioned by closely engaging fasteners inserted therein;

d. a plurality of carrying member bore holes drilled in said carrying member in registration with said carrying member openings formed in said upper portions of said first and second side members and dimensioned for closely engaging fasteners inserted therein;

e. a plurality of carried member bore holes drilled in said carried member in registration with said carried member openings formed in said lower portions of said first and second side members and dimensioned for closely engaging fasteners inserted therein;

f. a plurality of carrying fasteners dimensioned for insertion through said carrying member openings of said first and second side members and through said carrying member bore holes of said carrying member;

g. a plurality of carried fasteners dimensioned for insertion through said carrier member openings of said first and second side members and through said carried member bore holes of said carried member h. said first and second side members are integrally formed with carrying mid-portions located below and adjacent to said carrying member openings;

i. said first and second side members are integrally formed with carried mid-portions located above and adjacent to said carried member openings;

j. said carrying mid-portions of said first and second side members are formed with a carrying member series of horizontally restraining obround openings dimensioned and positioned for permitting relative vertical movement of fasteners therein;

k. said carried mid-portions of said first and second side members are formed with a carried member series of horizontally restraining obround openings dimensioned and positioned for permitting relative vertical movement of fasteners therein;

l. a plurality of horizontally restraining carrying member bore holes drilled in said carrying member in registration with said carrying member series of horizontally restraining openings formed in said carried mid-portions of said first and second side members;

m. a plurality of horizontally restraining carried member bore holes drilled in said carried member in registration with said carried member series of horizontally restraining openings formed in said carried mid-portions of said first and second side members;

n. a plurality of horizontally restraining carrying member fasteners dimensioned for insertion through said carrying member series of horizontally restraining obround openings and said horizontally restraining bore holes drilled in said carrying member;

o. a plurality of horizontally restraining carried member fasteners dimensioned for insertion through said carried member series of horizontally restraining obround openings and horizontally restraining bore holes drilled in said carried member.

p. each of said first and second side members are respectively continuous between said carried member openings and said carried member series of horizontally restraining obround openings;

q. each of said first and second side members are respectively continuous between said carrying member openings and said carrying member series of horizontally restraining obround openings; and r. each of said first and second side members are respectively continuous between said carrying member series of horizontally restraining obround openings and said carried member series of horizontally restraining obround openings providing torsional resistance of said carried member relative to said carrying member.

2. A hinge connection as described in claim 1 comprising:

a said carrying member series of horizontally restraining openings, and said carried member series of horizontally restraining openings are generally located at the same elevation.

3. A hinge connection as described in claim 3 comprising:

a. said carrying member series of horizontally restraining openings and said carried member series of horizontally restraining openings, are located so that some are located at different elevations so as to avoid creating split planes in said carried and carrying members.

* * * * *

UNITED STATES PATENT AND TRADEMARK OFFICE

CERTIFICATE OF CORRECTION

PATENT NO. : 5,324,132

DATED : June 28, 1994

INVENTOR(S) : Norman R. Hunter and John G. Herrera

It is certified that error appears in the above-identified patent and that said Letters Patent is hereby corrected as shown below:

Column 3, line 10, before the words "openings 49 & 50 dimensioned" insert ---obround---

Signed and Sealed this

First Day of November, 1994

*Attest:*

*Attesting Officer*

BRUCE LEHMAN

*Commissioner of Patents and Trademarks*